US007682201B2

(12) United States Patent
Chen et al.

(10) Patent No.: US 7,682,201 B2
(45) Date of Patent: Mar. 23, 2010

(54) CABLE CONNECTOR PLUG HAVING CONTACT WITH CURVED EXTENSION PORTION

(75) Inventors: Wu-Kuang Chen, Taipei Hsien (TW); Hsiaw-Chiang Chen, Taipei Hsien (TW); Min-Qiang Zhang, Shenzhen (CN); Chang-Hua Liao, Shenzhen (CN); Guo-Zhong Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 546 days.

(21) Appl. No.: 11/672,862

(22) Filed: Feb. 8, 2007

(65) Prior Publication Data

US 2008/0160843 A1 Jul. 3, 2008

(30) Foreign Application Priority Data

Dec. 29, 2006 (CN) ..... 200610201467

(51) Int. Cl.
*H01R 24/04* (2006.01)

(52) U.S. Cl. ..... 439/668

(58) Field of Classification Search ..... 439/668, 439/669, 869, 188, 638
See application file for complete search history.

(56) References Cited

U.S. PATENT DOCUMENTS

| | | | | |
|---|---|---|---|---|
| 4,018,501 | A * | 4/1977 | Maloof | 439/669 |
| 6,394,852 | B1 * | 5/2002 | Huang | 439/669 |
| 6,439,933 | B1 * | 8/2002 | Moji | 439/669 |
| 6,616,487 | B1 * | 9/2003 | Lai | 439/668 |
| 7,241,179 | B2 * | 7/2007 | Chennakeshu | 439/668 |
| 2002/0025728 | A1 * | 2/2002 | D'Addario et al. | 439/668 |

* cited by examiner

*Primary Examiner*—Chandrika Prasad
(74) *Attorney, Agent, or Firm*—Frank R. Niranjan

(57) ABSTRACT

An exemplary cable connector plug (20) includes a first contact (21). The first contact includes a contact portion (210) and an extension portion (211) extending from the contact portion along an axis of the cable connector plug. The extension portion includes a first columnar portion (2111), a neck portion (2112) and a second columnar portion (2113). The neck portion interconnects the first columnar portion and the second columnar portion. A periphery of a junction where the neck portion connects with the second columnar portion is curved from a point of the periphery distal from the second columnar portion to a point of the periphery distal from the neck portion. The cable connector plug has a relatively good mechanical strength and durability.

19 Claims, 4 Drawing Sheets

CABLE CONNECTOR PLUG HAVING CONTACT WITH CURVED EXTENSION PORTION

CROSS-REFERENCE TO RELATED APPLICATIONS

This application is related to two U.S. patent applications, application Ser. No. 11/672,870, entitled "CABLE CONNECTOR PLUG HAVING CONTACT WITH HOOKING PORTION", wherein the inventor is Wu-Kuang Chen et al, and application Ser. No. 11/672,872, entitled "CABLE CONNECTOR PLUG HAVING CONTACT WITH ANTI-ROTATION MEMBER", wherein the inventor is Wu-Kuang Chen et al. Such applications have the same assignee as the present application and have been concurrently filed herewith. The disclosures of the above identified applications are incorporated herein by reference.

BACKGROUND OF THE INVENTION

1. Field of the Invention

The present invention relates to electrical connectors, and more particularly to a cable connector plug used in a connector for transmitting audio signals or other signals.

2. Discussion of the Related Art

FIG. 4 shows a side cross-sectional view of a conventional cable connector plug 10. The cable connector plug 10 includes a first metallic contact 11, a second metallic contact 12, a third metallic contact 13, a fourth metallic contact 14, and a plurality of insulators 15. The metallic contacts 11, 12, 13, 14 are insulated from each other by the insulators 15.

The first contact 11 includes a contact portion 110, an extension portion 111 extending rearwardly from the contact portion 110 along an axis of the cable connector plug 10, and a rear portion 112 extending rearwardly from the extension portion 111. The extension portion 111 includes a first columnar portion 1111, a neck portion 1112, and a second columnar portion 1113. The neck portion 1112 interconnects the first columnar portion 1111 and the second columnar portion 1113. A diameter of the first columnar portion 1111 is greater than that of the second columnar portion 1113. A shape of the neck portion 1112 is a conical frustum that tapers from an end at the first columnar portion 1111 to an opposite end at the second columnar portion 1113. A combined length of the first columnar portion 1111 and the neck portion 1112 along the axis is usually 2.4 millimeters.

The second and third contacts 12, 13 each include an annular contact portion 120, 130, a cylindrical extension portion 121, 131 extending rearwardly from the contact portion 120, 130, and a rear portion 122, 132 extending rearwardly from the extension portion 121, 131. The fourth contact 14 includes a cylindrical contact portion 140, an annular extension portion 141 extending rearwardly from the contact portion 140, and a rear portion 142 extending from the extension portion 141. The extension portions 111, 121, 131, 141 of the first, second, third, and fourth contacts 11, 12, 13, 14 are coaxially arranged in that order from an inside to an outside of the cable connector plug 10. Accordingly, diameters of the extension portions 111, 121, 131, 141 increase in that sequence. The contact portions 110, 120, 130, 140 of the contacts 11, 12, 13, 14 are insulated from each other by a plurality of annular insulating ring portions (not labeled) of the insulators 15. The extension portions 111, 121, 131, 141 of the contacts 11, 12, 13, 14 are insulated from each other by a plurality of cylindrical portions (not labeled) of the insulators 15.

The rear portion 112 of the first contact 11 extends rearwardly beyond the insulators 15 for soldering with a first wire (not shown) of a cable (not shown). A rearmost part of the rear portion 122 of the second contact 12 is exposed for soldering with a second wire (not shown) of the cable. The other part of the rear portion 122 of the second contact 12 is embedded between the corresponding insulators 15. A rearmost part of the rear portion 132 of the third contact 13 is exposed for soldering with a third wire (not shown) of the cable. The other part of the rear portion 132 of the third contact 13 is embedded between the corresponding insulators 15. The rear portion 142 of the fourth contact 14 extends perpendicularly outward from the insulator 15 that is between the third and fourth contacts 13, 14, and is for soldering with a fourth wire (not shown) of the cable.

Generally, the neck portion 1112 of the first contact 11 angularly connects with the second columnar portion 1113, such that an angular junction is defined where the neck portion 1112 connects with the second columnar portion 1113. When force is applied to the contact portion 110 at angles close to 90 degrees relative to the axis, pressure received by the neck portion 1112 and the second columnar portion 1113 accumulates at a circular periphery of the angular junction. If the pressure is greater than a critical pressure of the extension portion 111, the extension portion 111 is liable to break at the angular junction where the neck portion 1112 connects with the second columnar portion 1113. Therefore, the mechanical strength and durability of the cable connector plug 10 is limited.

What is needed, therefore, is a new cable connector plug which can overcome the above-described shortcomings.

SUMMARY

A cable connector plug according to a preferred embodiment includes a first metallic contact. The first metallic contact includes a contact portion, and an extension portion extending from the contact portion along an axis of the cable connector plug. The extension portion includes a first columnar portion, a neck portion and a second columnar portion. The neck portion connects the first columnar portion and the second columnar portion. A junction where the neck portion connects with the second columnar portion is curved.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present cable connector plug. Moreover, in the drawings, like reference numerals designate corresponding parts throughout the several views, and all the views are schematic.

DETAILED DESCRIPTION OF THE PREFERRED EMBODIMENTS

Reference will now be made to the drawings to describe preferred embodiments of the present cable connector plug, in detail.

Figure 1:
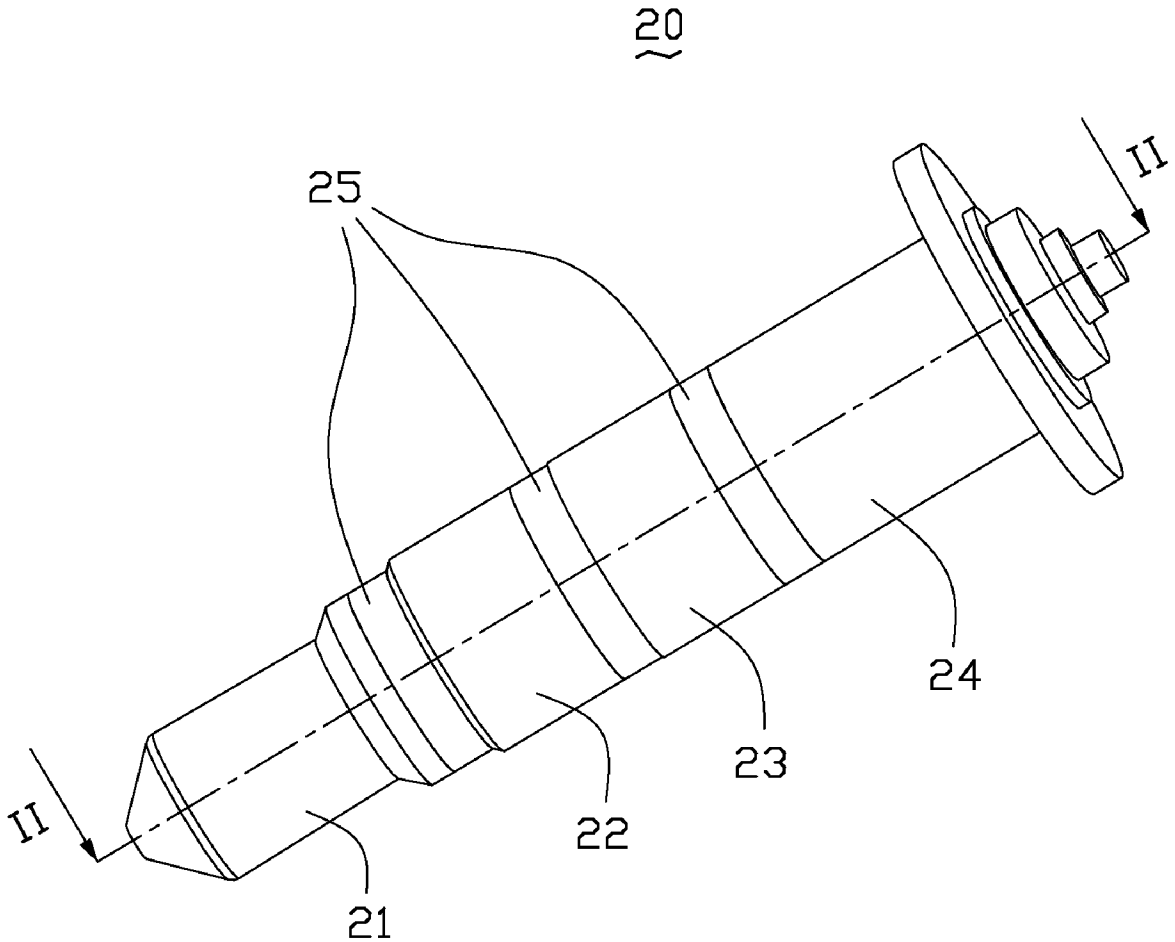
FIG. 1 is an isometric view of a cable connector plug according to a preferred embodiment of the present invention.
Figure 2:
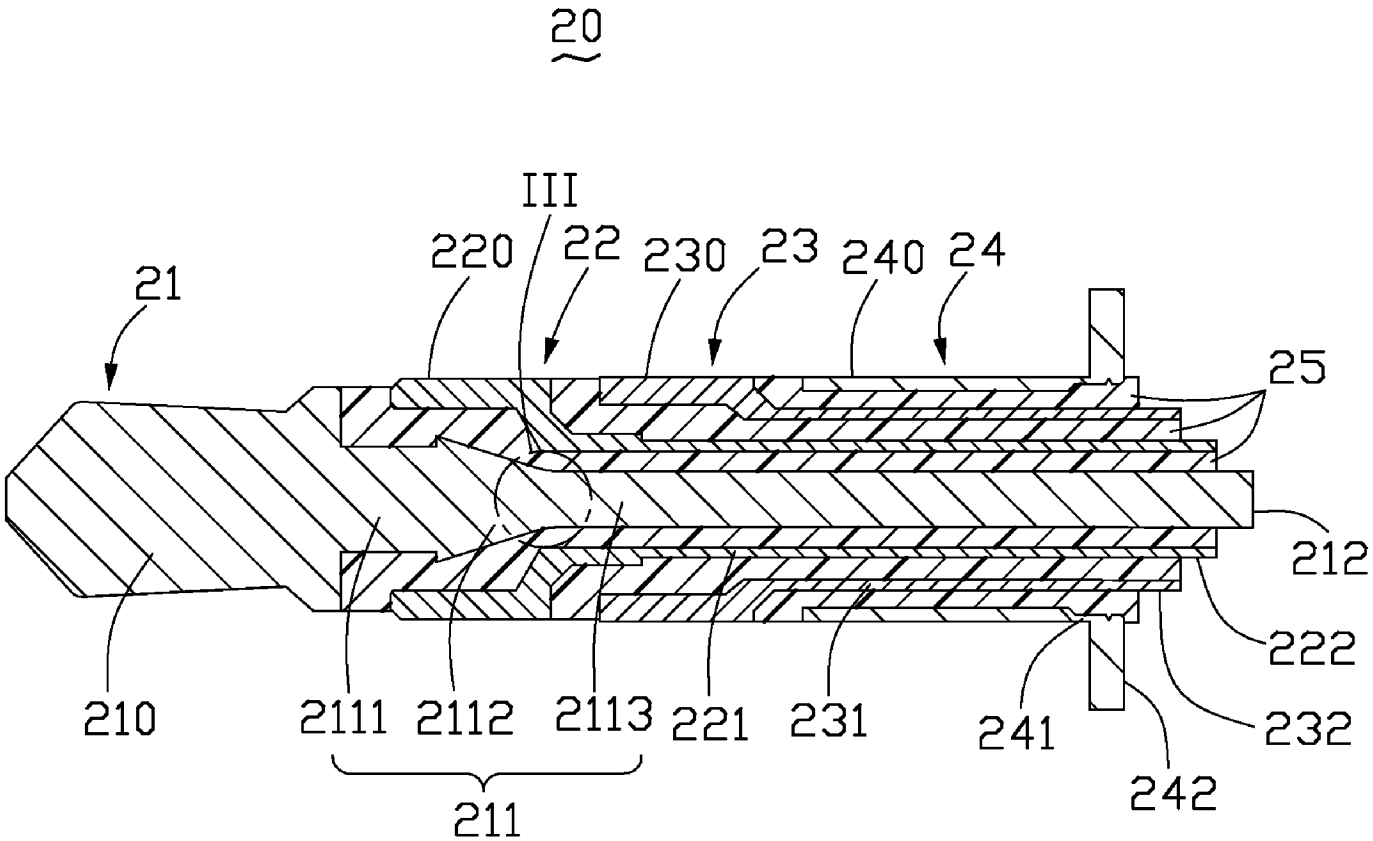
FIG. 2 is a side, cross-sectional view of the cable connector plug of FIG. 1, taken along line II-II thereof.

Referring to FIGS. 1 and 2, a cable connector plug 20 according to a preferred embodiment of the present invention is shown. The cable connector plug 20 includes a first metallic contact 21, a second metallic contact 22, a third metallic contact 23, a fourth metallic contact 24, and a plurality of insulators 25. The metallic contacts 21, 22, 23, 24 are insulated from each other by the insulators 25.

The first contact 21 includes a contact portion 210, an extension portion 211 extending rearwardly from the contact portion 210 along an axis of the cable connector plug 20, and a rear portion 212 extending rearwardly from the extension portion 211. The extension portion 211 includes a first columnar portion 2111, a neck portion 2112, and a second columnar portion 2113. The neck portion 2112 interconnects the first and second columnar portions 2111, 2113. The first and second columnar portions 2111, 2113 are both cylindrical. A diameter of the first columnar portion 2111 is greater than that of the second columnar portion 2113. A shape of the neck portion 2112 is generally a conical frustum that tapers from an end at the first columnar portion 2111 to an opposite end at the second columnar portion 2113.

The second and third contacts 22, 23 each include an annular contact portion 220, 230, a cylindrical extension portion 221, 231 extending rearwardly from the contact portion 220, 230, and a rear portion 222, 232 extending rearwardly from the extension portion 221, 231. The fourth contact 24 includes a cylindrical contact portion 240, an annular extension portion 241 extending rearwardly from the contact portion 240, and a rear portion 242 extending from the extension portion 241. The extension portions 211, 221, 231, 241 of the first, second, third, and fourth contacts 21, 22, 23, 24 are coaxially arranged in that order from an inside to an outside of the cable connector plug 20. Accordingly, diameters of the extension portions 211, 221, 231, 241 increase in that sequence. The contact portions 210, 220, 230, 240 of the contacts 21, 22, 23, 24 are insulated from each other by a plurality of ring portions (not labeled) of the insulators 25. The extension portions 211, 221, 231, 241 of the contacts 21, 22, 23, 24 are insulated from each other by a plurality of cylindrical portions (not labeled) of the insulators 25.

The rear portion 212 of the first contact 21 extends rearwardly beyond the insulator 25 for soldering with a first wire (not shown) of a cable (not shown). A rearmost part of the rear portion 222 of the second contact 22 is exposed for soldering with a second wire (not shown) of the cable. The other part of the rear portion 222 of the second contact 22 is embedded between the corresponding insulators 25. A rearmost part of the rear portion 232 of the third contact 23 is exposed for soldering with a third wire (not shown) of the cable. The other portion of the rear portion 232 of the third contact 23 is embedded between the corresponding insulators 25. The rear portion 242 of the fourth contact 24 extends perpendicularly outward from the insulator 25 that is between the third and fourth contacts 23, 24, and is for soldering with a fourth wire (not shown) of the cable.

Figure 3:
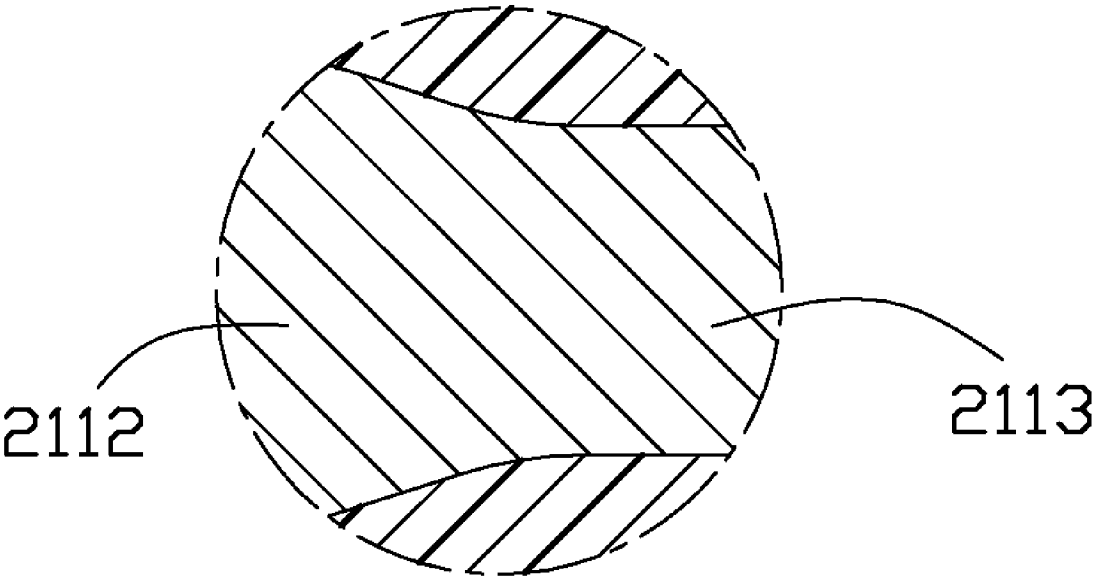
FIG. 3 is an enlarged view of a circle portion III-III of FIG. 2.
Figure 4:
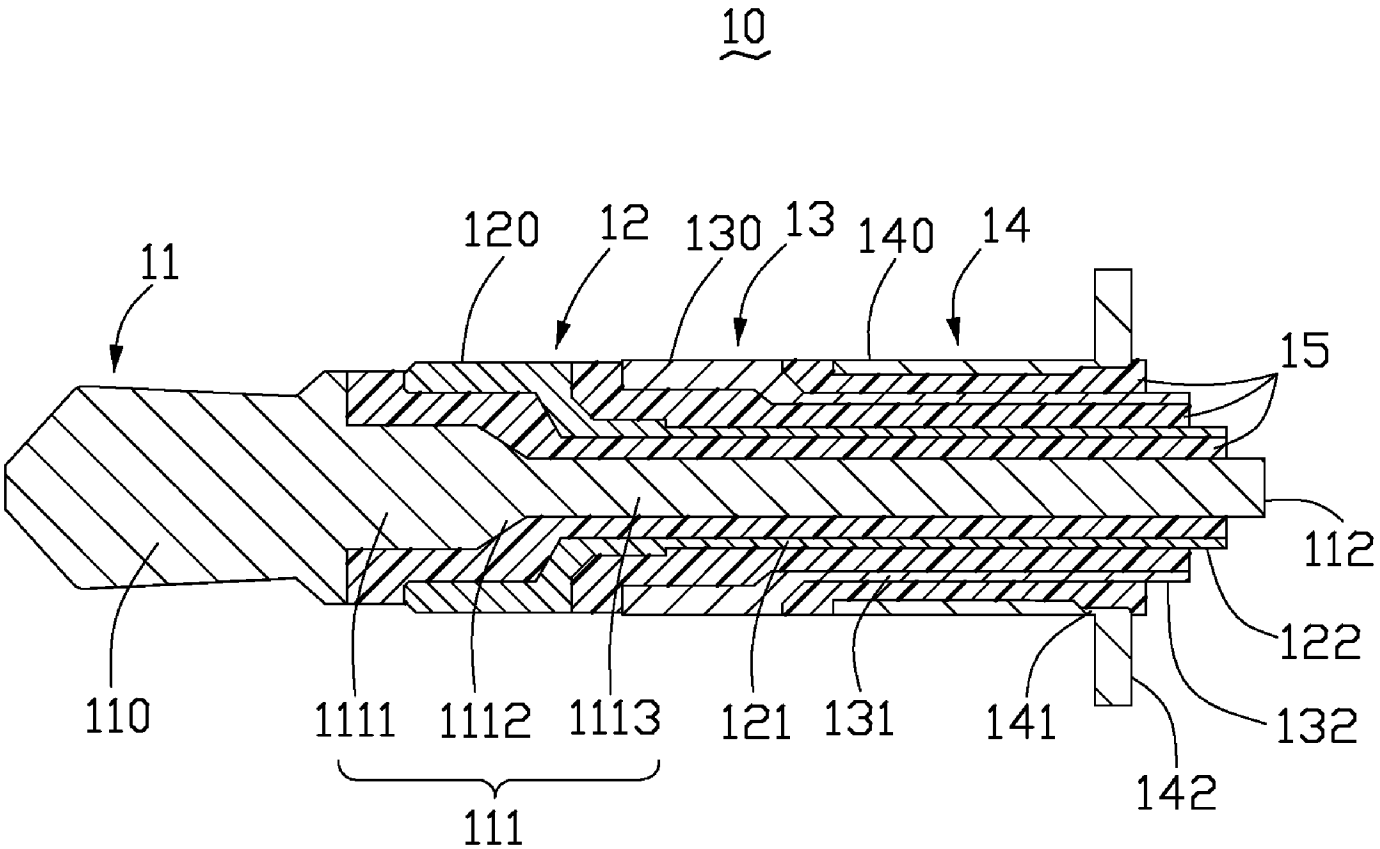
FIG. 4 (RELATED ART)
FIG. 4 is a side, cross-sectional view of a conventional cable connector plug.

Referring to FIGS. 2 and 3, a junction where the neck portion 2112 of the first contact 21 connects with the second columnar portion 2113 is curved. The curvature can for example define an arcuate cross-section or an arc-shaped cross-section. When force is applied to the contact portion 210 at angles close to 90 degrees relative to the axis, pressure received by the neck portion 2112 and the second columnar portion 2113 does not significantly accumulate at the junction where the neck portion 2112 connects with the second columnar portion 2113. The curved junction shared by the neck portion 2112 and the second columnar portion 2113 in effect enables the pressure to be relatively evenly and efficiently distributed through the neck portion 2112 and the second columnar portion 2113. Therefore, the extension portion 211 is not easily broken at the curved junction where the neck portion 2112 connects with the second columnar portion 2113. In other words, the extension portion 211 can safely sustain a relatively large amount of force that is applied to the contact portion 210. Thus a mechanical strength and durability of the cable connector plug 20 are improved.

A combined length of the first columnar portion 2111 and the neck portion 2112 along the axis is equal to or greater than 2.4 millimeters. Preferably, the combined length is in a range from about 2.6 millimeters to about 3.2 millimeters. The combined length of the first columnar portion 2111 and the neck portion 2112 is located relatively deeply within the annular contact portion 220 of second contact 22. In particular, the neck portion 2112 is disposed adjacent to an inner wall of the contact portion 220. When force is applied to the contact portion 210 of the first contact 21 at angles close to 90 degrees relative to the axis, the contact portion 220 helps to support the extension portion 211 of the first contact 21, such that the extension portion 211 is not easily broken at the curved junction where the neck portion 2112 connects with the second columnar portion 2113. Accordingly, the mechanical strength and durability of the cable connector plug 20 are improved.

The metallic contacts 21, 22, 23, 24 are made of material having good electrical conductive capability, such as copper, aluminum and so on. In order to ensure good electrical contact and attain an aesthetically pleasing surface, an anticorrosion coating can be formed on an outer surface of each of the metallic contacts 21, 22, 23, 24. The anticorrosion coating is preferably made of nickel. The insulators 25 are preferably made of polyamide resin.

It is should be noted that in alternative embodiments, the first and second cylindrical columnar portions 2111, 2113 of the extension portion 211 can instead be rectangular columns. In such case, the neck portion interconnecting the first and second columnar portions is substantially a four-sided pyramidal frustum. A junction where the neck portion connects with the second columnar portion is also curved where outer planes of the neck portion connect with corresponding outer planes of the second columnar portion. The rectangular columns can be square. The four-sided pyramidal frustum can be a square pyramidal frustum. The first and second cylindrical columnar portions 2111, 2113 of the extension portion 211 can instead be polygonal columns. In such case, the neck portion interconnecting the first and second columnar portions is substantially a polygonal pyramidal frustum. A junction where the neck portion connects with the second columnar portion is also curved where outer planes of the neck portion connect with corresponding outer planes of the second columnar portion.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector plug, comprising:

a first contact, the first contact comprising:

a contact portion, and an extension portion extending from the contact portion along an axis of the cable connector plug, the extension portion including a first columnar portion, a neck portion and a second columnar portion aligned with one another, wherein the neck portion interconnects the first columnar portion and the second columnar portion, and a periphery of a junction where the neck portion connects with the second columnar portion is curved from a point of the periphery distal from the second columnar portion to a point of the periphery distal from the neck portion.

2. The cable connector plug according to claim 1, wherein the first and second columnar portions are both cylindrical, a diameter of the first columnar portion is greater than that of the second columnar portion, and a shape of the neck portion is substantially a conical frustum that tapers from an end at the first columnar portion to an opposite end at the second columnar portion.

3. The cable connector plug according to claim 1, wherein the first and second columnar portions of the extension portion are both rectangular columns, and the neck portion is substantially a four-sided pyramidal frustum interconnecting the first and second columnar portions.

4. The cable connector plug according to claim 1, wherein a combined length of the first columnar portion and the neck portion along the axis is equal to or greater than 2.4 millimeters.

5. The cable connector plug according to claim 1, wherein the first contact further comprises a rear portion of extending rearwardly from the extension portion and protruding from a rear end of the cable connector plug.

6. The cable connector plug according to claim 1, further comprising a second contact and a first insulator, the second contact having an annular contact portion, a cylindrical extension portion extending rearwardly from the contact portion, and a rear portion extending rearwardly from the extension portion, wherein the extension portions of the first and second contacts are coaxially arranged in that order from an inside of the cable connector plug, the contact portions of the first and second contacts are insulated from each other by a ring portion of the insulator, and the extension portions of the first and second contacts are insulated from each other by a cylindrical portion of the insulator.

7. The cable connector plug according to claim 6, further comprising a third contact, a fourth contact, a second insulator, and a third insulator, wherein the third contact comprises an annular contact portion, a cylindrical extension portion extending rearwardly from the contact portion, and a rear portion extending rearwardly from the extension portion, the fourth contact each comprises a cylindrical contact portion, an annular extension portion extending rearwardly from the contact portion, and a rear portion extending from the extension portion, the extension portions of the first, second, third, and fourth contacts are coaxially arranged in that order from the inside of the cable connector plug, diameters of the extension portions of the first, second, third, and fourth contacts increase in that sequence, the contact portions of the second and third contacts are insulated from each other by a ring portion of the second insulator, the extension portions of the second and third metallic contacts are insulated from each other by a cylindrical portion of the second insulator, the contact portions of the third and fourth contacts are insulated from each other by a ring portion of the third insulator, and the extension portions of the third and fourth metallic contacts are insulated from each other by a cylindrical portion of the third insulator.

8. The cable connector plug according to claim 7, wherein the first, second, and third insulators are made of polyamide resin.

9. The cable connector plug according to claim 7, wherein the first, second, third, and fourth contacts are each made of metallic material.

10. The cable connector plug according to claim 9, further comprising an anticorrosion coating deposited on an outer surface of each of the first, second, third, and fourth contacts.

11. The cable connector plug according to claim 10, wherein the anticorrosion coating is made of nickel.

12. A cable connector plug, comprising:

a first contact, the first contact comprising:

a contact portion; and an extension portion extending from the contact portion along an axis of the cable connector plug, the extension portion including:

a first columnar portion, a neck portion, and a second columnar portion aligned with one another, wherein the neck portion interconnects the first columnar portion and the second columnar portion, and an axial cross-section of a joint area where the second columnar portion extends from the neck portion has a curved boundary.

13. The cable connector plug according to claim 12, wherein the first and second columnar portions are both cylindrical, a diameter of the first columnar portion is greater than that of the second columnar portion, and a shape of the neck portion is substantially a conical frustum that tapers from an end at the first columnar portion to an opposite end at the second columnar portion.

14. The cable connector plug according to claim 12, wherein first and second columnar portions of the extension portion are both rectangular columns, and the neck portion is substantially a four-sided pyramidal frustum interconnecting the first and second columnar portions.

15. The cable connector plug according to claim 12, wherein a combined length of the first columnar portion and the neck portion along the axis is equal to or greater than 2.4 millimeters.

16. The cable connector plug according to claim 12, wherein the first contact further comprises a rear portion of extending rearwardly from the extension portion and protruding from a rear end of the cable connector plug.

17. The cable connector plug according to claim 12, further comprising a second contact and a first insulator, the second contact having an annular contact portion, a cylindrical extension portion extending rearwardly from the contact portion, and a rear portion extending rearwardly from the extension portion, wherein the extension portions of the first and second contacts are coaxially arranged in that order from an inside of the cable connector plug, the contact portions of the first and second contacts are insulated from each other by a ring portion of the insulator, and the extension portions of the first and second contacts are insulated from each other by a cylindrical portion of the insulator.

18. The cable connector plug according to claim 17, further comprising a third contact, a fourth contact, a second insulator, and a third insulator, wherein the third contact comprises an annular contact portion, a cylindrical extension portion extending rearwardly from the contact portion, and a rear portion extending rearwardly from the extension portion, the fourth contact each comprises a cylindrical contact portion, an annular extension portion extending rearwardly from the contact portion, and a rear portion extending from the extension portion, the extension portions of the first, second, third, and fourth contacts are coaxially arranged in that order from the inside of the cable connector plug, diameters of the extension portions of the first, second, third, and fourth contacts increase in that sequence, the contact portions of the second and third contacts are insulated from each other by a ring portion of the second insulator, the extension portions of the second and third metallic contacts are insulated from each other by a cylindrical portion of the second insulator, the contact portions of the third and fourth contacts are insulated from each other by a ring portion of the third insulator, and the extension portions of the third and fourth metallic contacts are insulated from each other by a cylindrical portion of the third insulator.

19. The cable connector plug according to claim 12, wherein the curved boundary is arcuate or arc-shaped.

* * * * *